US006656886B1

(12) United States Patent
Johnson

(10) Patent No.: US 6,656,886 B1
(45) Date of Patent: Dec. 2, 2003

(54) LUBRICANT FOR SMOOTHING CAULKING JOINTS AND METHOD OF USE

(76) Inventor: Philip Thoralf Johnson, 768 Indian Hills Rd., Fontana, WI (US) 53125

( * ) Notice: Subject to any disclaimer, the term of this patent is extended or adjusted under 35 U.S.C. 154(b) by 82 days.

(21) Appl. No.: 10/037,714

(22) Filed: Dec. 31, 2001

(51) Int. Cl.[7] ..... C10M 173/00; C10M 141/02

(52) U.S. Cl. ..... 508/179; 508/216; 508/389; 508/390; 508/545; 508/551; 508/583

(58) Field of Search ..... 508/165, 179, 508/216, 389, 390, 545, 551, 583

(56) References Cited

U.S. PATENT DOCUMENTS 5,352,376 A * 10/1994 Gutzmann ..... 508/216
5,549,836 A * 8/1996 Moses ..... 508/183
5,559,087 A * 9/1996 Halsrud et al. ..... 508/579
5,565,127 A * 10/1996 Laufenberg et al. ..... 508/220
5,622,728 A 4/1997 Kartler
5,700,766 A * 12/1997 Hellsten et al. ..... 508/500
5,723,418 A * 3/1998 Person Hei et al. ..... 508/511
5,863,874 A * 1/1999 Person Hei et al. ..... 508/521
6,461,691 B1 * 10/2002 Taylor et al. ..... 427/518

* cited by examiner

*Primary Examiner*—Jacqueline V. Howard
(74) *Attorney, Agent, or Firm*—Dorothy S. Morse

(57) ABSTRACT

A water-based, phosphate-free, non-toxic, and biodegradable lubricant used for smoothing and shaping a bead of caulking compound sealant, and a method for its use, which can be easily removed from the caulking compound sealant bead after it is allowed to cure. Applied to a bead of newly dispensed caulking compound sealant, the present invention lubricant will not chemically interact with, prevent the curing of, or otherwise contaminate the caulking compound sealant. Instead, direct application of the present invention to a bead of caulking compound sealant, or application via a finger or man-made tool, and subsequent smoothing with the finger or tool will allow correction of all imperfections in the caulking bead prior to curing. Applications may include, but are not limited to, use in construction, marine, automotive, aircraft, electronic, and manufacturing industries with caulking sealants made from silicone, elastomer, urethane, polyurethane, polymers, butyls, poly-sulfide lithoseals, thiokols, and epoxys.

20 Claims, No Drawings

LUBRICANT FOR SMOOTHING CAULKING JOINTS AND METHOD OF USE

BACKGROUND

1. Field of Invention

This invention relates to means for establishing a smooth, aesthetically pleasing, error-free caulking joint, specifically to a water-based, phosphate-free, non-toxic, and biodegradable lubricant composition containing a combination of surfactants and stabilizer, as well as a method for its use, that can be easily removed following the curing of the caulking compound sealant. Applied directly to a bead of caulking compound sealant newly dispensed from the manufacturer's tube or with use of a caulking gun, the present invention lubricant will not chemically interact with, prevent sealant curing, or otherwise contaminate the caulking compound sealant. Instead, application of the present invention by a user to a new bead of caulking compound sealant will allow the user to correct all imperfections in the caulking bead before it becomes cured. Applications may include, but are not limited to, use with caulking sealant made from silicone compounds, elastomer compounds, urethane and polyurethane compounds, polymers, butyls, poly-sulfide lithoseals, thiokols, and epoxys that are employed in a variety of industries to obtain a defined finished effect, such as but not limited to, the construction, marine, automotive, aircraft, electronic, and manufacturing industries.

2. Description of Prior Art

Caulking compound sealants are used for many purposes. They weatherproof joints and can provide a structural glazing function. Caulking compound sealants further can provide a secure bond between materials having different surface textures, porosities, and coefficients of expansion. Most caulking compound sealants are dispensed from a manufacturer's tube or with use of conventional caulking equipment, such as a caulking gun having a trigger-like actuator connected to a plunger. Operator skill and experience are generally required for aesthetically pleasing results. Also for most effective joint performance, the width and bed depth of a caulking bead must be appropriate to the application. Once a bead of caulking compound sealant is dispensed into a joint, tooling is usually recommended to smooth the exposed surface of the caulking bead, eliminate irregularities in the edges of the caulking bead and make the width and bed depth of the bead more uniform, as well as to eliminate air bubbles within the bead and otherwise ensure full contact of the caulking bead with the joint. A finger moistened with water or saliva and drawn with at least light pressure across the surface of a caulking bead is an easy and widely used caulk tooling means. However, the finger employed must be frequently remoistened to provide the degree of smoothness desired in the bead and avoid accumulation of the caulking compound sealant on the finger. In spite of precautions taken by operators when saliva or water is used as the finger moistening means, it is the depositing of caulking compound sealant on the finger employed to smooth it that signals a need for the operator to remoisten the finger. Thus, when saliva or water is used as the finger moistening agent sealant, chemicals repeatedly come in contact with an operator's tooling finger or fingers, and when saliva is used as the finger moistening agent, the process of remoistening the finger almost always results in the depositing of some caulking agent into the operator's mouth. Although the quantity of caulking compound sealants ingested at any one time may be small and have little effect on the overall health of a person attempting to tool caulking compound, repeated dermal contact with, and/or direct ingestion of, the sealant chemicals over a period of years can result in serious and harmful health effects. Hair loss over the entire body has been know to occur in some professionals using saliva and a finger for smoothing caulking compound sealants. Other known adverse consequences can range from treatable dry skin, skin redness and irritation, and other treatable forms of contact dermatitis, to irreparable damage to organs and tissues. To avoid serious health risk to both the occasional and professional operator, it would be useful to have a method for tooling caulking beads that is as simple, convenient, inexpensive, and as easy to use as a water-moistened or saliva-moistened finger, however one that does not permit direct contact and accumulation of the caulking compound sealant on an operator's finger or tongue.

Several devices are known for use in smoothing a caulking bead and attach to either a caulking gun or to the manufacturer's tube used to contain caulking compound sealant. One such device is disclosed in U.S. Pat. No. 5,622,728 to Kartler (1997). The Kartler invention comprises a wiping device that can be mounted on a caulking gun and used for wiping and smoothing the surface of a caulking bead immediately after it is dispensed to a corner joint. The Kartler device combines the application and smoothing of caulking compounds into a single step. However, the Kartler device is not easily retrofitted to caulking compound sealants dispensed from a manufacturer's tube as the forward wall of the tube would need to be strengthened to serve as the mounting means for the wiping arm. In contrast, although application and tooling are accomplished in separate steps, the present invention provides a water-based lubricant composition containing a combination of surfactants and stabilizer that enables a finger or simple tool to be used in tooling newly dispensed caulking compound sealant. Also, the present invention provides many advantages. It is inexpensive, easy to apply and easily removed after caulking compound curing, and it provides the operator with a sanitary and non-toxic lubricant product for making the familiar and trusted finger-method of smoothing caulking compound sealants a safe one for operator use. The present invention is also phosphate-free to address environmental concerns, non-contaminating to the caulking compound ingredients, and biodegradable when rinsed from the caulking bead after curing. Further its use provides reliable caulk smoothing results, and as the ingredients in the present invention cause residual amounts of it to adhere to the operator's caulk smoothing finger, the caulking compound sealants do not come in contact with the operator's skin or tongue and the operator is thereby protected from the serious health risks previously posed. No means of tooling a caulking bead is known that has all of the advantages of the present invention.

SUMMARY OF INVENTION—OBJECTS AND ADVANTAGES

The primary object of this invention is to provide a lubricant product and method of its use for removing all of the imperfections in a newly dispensed caulking bead that are simple, easy to use, and eliminate the health risks previously imposed on an operator using a saliva or water moistened finger to smooth caulking compound sealants. It is a further object of this invention to provide a caulking bead lubricant product that comprises non-toxic and biodegradable components. It is also an object of this invention to provide a caulking bead tooling means that can be used with beads of caulking dispensed directly from a manufacturer's tube, as well as through the use of a caulking gun. A further object of this invention is to provide a caulking bead tooling lubricant means that can be easily removed from the caulking bead after the caulking compound sealant is cured. It is also an object of this invention to provide a caulking bead tooling lubricant means that does not interfere with the curing process of the caulking compound sealant in the bead or otherwise chemically interact with the caulking compound sealant so as to diminish its ability to properly fulfill its joint sealing function.

As described herein, properly manufactured and used, the present invention would enable even those inexperienced in caulking compound sealant application to rapidly tool a newly dispensed caulking bead into a smooth, uniform, and aesthetically appealing configuration. Since the present invention is non-toxic, it could be applied from a tube or other container directly onto a user's finger without adverse affect to the user, and the ingredients in the present invention would cause residual amounts of it to remain on the finger and protect the finger from direct contact with the caulking compound sealants it is employed to smooth. In the alternative, the present invention could be applied directly to the caulk bead and fulfill the same finger protecting function. The user's finger would no longer need to be moistened with water or saliva, thus eliminating the serious health risks posed by direct caulking compound sealant dermal contact and ingestion. The present invention also eliminates the need for a specialized tool or one that would require special cleaning and/or disposal. Further, since it is water-based, made from a combination of surfactants and stabilizer, does not contain phosphates, and it is biodegradable, the present invention is easily rinsed from the caulking bead after the caulking compound sealant has cured without concern of environment harm when frequently applied to a user's finger. The lubricant properties of the present invention would prevent the caulking compound sealant from adhering to the user's finger during tooling of the caulking bead, thus facilitating and speeding the caulk smoothing process. Also, the composition of the present invention allows it to be easily and rapidly rinsed from a user's finger, or tool when employment of a caulk-smoothing tool is preferred. The present invention would not chemically interact with the caulking compound sealant to prevent it from curing, nor would the present invention in any way react with the caulking compound to diminish its capability to properly perform the sealing function for which it was intended. Since the present invention is applied to a caulking bead after it is positioned within a joint, the present invention can be used to tool caulking compound sealant dispensed from a caulking gun, as well as that dispensed directly from a manufacturer's tube. During its application and use, the present invention helps to smooth the exposed surface of the caulking bead and eliminate irregularities in the edges of the caulking bead, while at the same time making the width and bed depth of the bead more uniform, eliminating air bubbles within the bead, and otherwise promoting full contact of the caulking bead with the joint into which it is placed. The same benefits are achieved whether the caulking bond is made between materials having similar or different surface textures, porosities, and coefficients of expansion. No caulk tooling means is known which has all of the advantages provided by the present invention.

The description herein provides the preferred embodiments of the present caulking bead tooling invention and method, but should not be construed as limiting their scope. For example, variations in the selection of surfactants used, the amount of the present invention lubricant applied to the finger, tool, or caulk bead, the number of time the finger or tool is allowed to pass over the newly applied caulk bead prior to reapplication of lubricant, and the type and concentration of stabilizer used, other than those shown and described herein may be incorporated into the present invention. Thus the scope of the present invention should be determined by the appended claims and their legal equivalents, rather than being limited to the examples given.

BRIEF DESCRIPTION OF THE DRAWINGS

No illustrations are included as part of the disclosure herein.

DETAILED DESCRIPTION OF PREFERRED EMBODIMENTS

Caulking compound sealants are widely used in the construction, marine, automotive, aircraft, electronics, and manufacturing industries. Often a defined finished effect is desired in a dispensed caulking bead for both aesthetic and structural purposes. Tooling is usually recommended after dispensing of caulking compound sealants to correct all imperfections in the caulking bead, including smoothing of the exposed surface of the bead, eliminating irregularities in the edges of the bead, making the width and bed depth of the bead more uniform, eliminating air bubbles within the bead, and otherwise ensuring full contact of the caulking bead with a joint. The present invention provides a water-based, phosphate-free, non-toxic, and biodegradable lubricant composition made from a combination of surfactants and stabilizer that can be employed for smoothing and shaping a newly applied caulking bead. The present invention can also be easily removed from the bead following curing of the caulking compound sealant therein to which it had been applied. The present invention does not dry out skin, or contain components known to cause contact dermatitis. Also, the ingredients in the present invention lubricate a finger used for smoothing a newly dispensed bead of caulk and keep the caulking compound sealant chemicals, some of which are known to cause organ and tissue damage as a result of dermal contact and/or ingestion, away from the user's skin and tongue. Drawn across the surface of a bead of caulking compound sealant shortly after the sealant has been dispensed either from the manufacturer's tube or with use of a caulking gun, the present invention lubricant will not chemically interact with or otherwise contaminate the caulking compound sealant. Instead, direct application of the present invention by a user to a bead of caulking compound sealant with the user's finger or a finger-like implement and drawing the finger or implement across the bead under at least light pressure will allow the user to correct all imperfections in the caulking bead. It remains an option of the user as to whether the present invention is applied to a finger and drawn across a bead of caulking compound sealant, or whether the user prefers to apply several drops of the present invention directly to the bead of caulking compound sealant and then draw the present invention across the caulking compound sealant bead with a finger or caulk smoothing tool.

The preferred embodiments of the present invention would each comprise a water-based, pH neutral composition containing at least one type of surfactant in combination with one or more stabilizers. Multiple surfactants can be used. Although not critical and not limited thereto, it is contemplated that in the most preferred embodiment of the present invention, surfactants could include the anionic surfactant sodium alkyl ethoxysulfate, the amine oxide surfactant dimethyl amine oxide, the non-ionic surfactant lauryl methyl glucamide, and/or one or more sodium or calcium xylenesulfonate surfactants. Also, although not limited thereto, stabilizers used in the most preferred embodiment of the present invention might include magnesium chloride, ethanol, or a combination thereof. One example of a preferred composition of the present invention, with the concentrations of ingredients being by weight, would comprise a minimum of approximately 4% to 40% anionic surfactant sodium alkyl ethoxysulfate, a maximum of approximately 10% dimethyl amine oxide surfactant, a maximum of approximately 20% non-ionic surfactant lauryl methyl glucamide, a maximum combined concentration of approximately 10% sodium and/or calcium xylenesulfonate surfactants, a maximum of approximately 10% magnesium chloride, and a maximum of approximately 5% ethanol, with the balance being water and minors, such as fragrance, hydrotropes, and thickening agents. The present invention caulk smoothing compound could also comprise antibacterial components, such as tricloran, although its use is not critical. When present in the most preferred embodiment, trichloran would have a concentration of approximately 0.2% by weight of the lubricant. Since the present invention has a neutral pH, it is contemplated that the present invention will be mild to human skin of a user and not dry out the skin of a user's finger when a finger is employed as a tool for smoothing the surface of a caulking compound sealant bead.

It is contemplated that present invention would be made from inexpensive ingredients and be easy to apply. The present invention would also be easy to remove after the caulking compound cures, simply by rinsing it off with water. For those experienced in smoothing a caulking bead with a finger, the present invention would provide the operator with a sanitary and non-toxic lubricant product for making the familiar and trusted finger-method of smoothing caulking compound sealants a safe one for operator use. Since it contains no toxic components and the surfactants in it cause residual amounts of the present invention to adhere to the operator's caulk smoothing finger, the caulking compound sealants no longer come in direct contact with the operator's skin or tongue and the operator is thereby protected from the serious health risks previously posed by direct dermal contact with, and/or ingestion of, the caulking compound sealant components. Use of the present invention also provides uniform and reliable caulk smoothing results, and it is intentionally phosphate-free to address environmental concerns. Further, the composition of the present invention is biodegradable, safe, sanitary, non-contaminating to the caulking compound ingredients, and does not chemically interact with the caulking compound sealant or affect its curing so as to diminish the ability of the caulking compound sealant to properly perform its joint sealing functions.

Using the present invention for tooling a bead of newly dispensed caulking compound sealant would generally comprise the steps of proving a caulking bead tooling implement, such as a human finger or a similarly configured man-made tool and something to use in removal of excess caulking compound from the joint, such as a piece of toweling or other absorbent material. Once the tooling implement is selected, an amount of lubricant composition sufficient to prevent the caulking compound sealant from adhering to the finger or man-made tool would either be placed upon the finger or smoothing surface of the manmade tool, or in the alternative upon the surface of the caulking bead near to one of its ends, and the finger or man-made tool would then be drawn with at least light pressure across the exposed surface of the caulking bead to smooth it, eliminate irregularities in the edges of the caulking bead, make the width and bed depth of the bead more uniform, eliminate air bubbles within the bead, and otherwise ensure full contact of the caulking bead with the joint. Typically, although not limited thereto, a four-foot section of newly applied caulking bead would be smoothed at one time, with approximately two drops of lubricant composition being applied to the finger or implement for every three linear inches of caulking bead. The smoothing process is best accomplished immediately after the caulking bead is laid, before it begins to skin over and become unworkable. As the tooling implement is moved over the caulking bead in contact with its upper surface, the lubricant separating the tooling implement from the caulking bead is spread out over the exposed surface of the smoothed caulking bead. When the remaining amount of lubricant composition positioned between the tooling implement and the caulking bead becomes inadequate to prevent accumulation of the caulking compound upon the finger or man-made tool, a fresh supply of lubricant composition must be placed between the tooling implement and the remaining portion of the unsmoothed caulking bead to continue the tooling process. Once the lubricant is on the caulk and the caulking bead has been initially smoothed, the finger or man-made tool may be drawn over the entire four-foot working length of caulking compound sealant two or three times, without the need for additional application of lubricant composition. When the user feels a drag sensation on the tooling implement before the smoothing process is complete, additional lubricant can be added to the caulk surface, finger, or man-made tool. For uniformity, the same finger would typically be used to smooth an entire length of caulking bead, and very light pressure is usually applied to the exposed upper surface of the caulking bead to provide the best seal. Further, although larger or smaller containers for the lubricant composition could be employed, since only two drops are typically necessary for every 2–3 linear inches of caulking compound, a four-ounce container size would be optimal and provide adequate lubricant composition to complete even large work projects, while also providing convenience to users by not requiring them to work with oversized, unnecessarily heavy, and/or awkward-to-use containers. At the user's option prior to the time of applying fresh lubricant composition, excess caulking compound sealant can be removed from the joint when needed with toweling or other absorbent material. Since the lubricant composition is water soluble and non-toxic, clean-up of the tooling implement after caulk bead smoothing is rapid, easy, and does not cause environmental harm.

Applications may include, but are not limited to, use with caulking sealants and adhesives made from silicone compounds, elastomer compounds, urethane and polyurethane compounds, polymers, butyls, poly-sulfide lithoseals, thiokols, and epoxys. For example, use of the present invention is contemplated for use in tooling newly dispensed caulking compound sealants and adhesives such as but not limited to:

Bostik products such as Bostik 1100 F. S. Sealant, Chem-Calk 1200 Sealant, Chem-Calk 2641 Sealant, Chem-Calk 300 Sealant, Chem-Calk 500 Sealant, Chem-Calk 550 Sealant, Chem-Calk 600 Sealant Chem-Calk 900 Sealant, Chem-Calk 915 Sealant, Chem-Calk 950 Sealant, Bostik 500 Urethane Sealant, Bostik 550 Urethane Sealant, and Bostik 900 Urethane Sealant;

Dow Corning Corporation products such as 790 Silicone Building Sealant, 791 Silicone Perimeter Sealant, 795

Silicone Building Sealant, 799 Silicone Glass and Metal Building Sealant, 983 Silicone Glazing and Curtain Wall Adhesive/Sealant, 955 Silicone Structural Adhesive, and 999-A Silicone Building and Glazing Sealant;

Poxy-Fil (J-52) Epoxy Joint Filler sold by Dayton Superior Corporation;

silicones of the General Electric Company such as Construction 1200 Sealant, Contractors SCS 1000 Sealant, LexSil SPS2900 Primerless Silicone Plastic Sealant, Sanitary 1700 Sealant, Siliglaze II SCS 2800 Sealant, Silpruf Weatherproofing Sealant, Ultraglaze 4000 One-Part Structural Glazing Sealant, and Ultraglaze 4400 Two-Part Structural Glazing Sealant;

H. B. Fuller Company products such as 200 Small Joint Seam Sealer, 707 Architectural Sealant, 757 Butly Sealant, and 877 Wall Panel Sealant;

Expansil Silicone Sealant sold by Harris Specialty Chemicals, Inc.;

IPC Vinylseal sold by Institutional Products Corporation;

L. M. Scofield Company products such as LITHOSEAL Buildingcalk-1G, LITHOSEAL Buildingcalk-3G, LITHOSEAL Buildingcalk-3S, LITHOSEAL Floorcalk, LITHOSEAL Glazecalk, LITHOSEAL Metalcalk-1G, LITHOSEAL Petrocalk, LITHOSEAL Trafficalk-3G, LITHOSEAL Watercalk-3G, and LITHOSEAL Watercalk-3S;

Marneco International, Inc. products such as Vulkem 922 Joint Sealant, Vulkem 116 Joint Sealant, Vulkem 202 Joint Sealant, Vulkem 227 Joint Sealant, Vulkem 230 Joint Sealant, Vulkem 245/255 Joint Sealant, Vulkem 45 Joint Sealant, Vulkem 921 Joint Sealant, and Vulkem NoVa 300 SSL Joint Sealant;

Morton International products such as Thiokol 1P One-Part Polysulfide Joint Sealant, Thiokol 2P Two-Part Polysulfide Joint Sealant, and Thiokol T-2407 Flexible Epoxy Joint Filler;

#110 Epoxy Stair Nose Caulk sold by R. C. Musson Rubber Company;

Pacific Polymers, Inc. products such as Elasto-Seal 200 Runway Sealant, Elasto-Seal 207 Sealant, Elasto-Seal 230 Sealant, Elasto-Thane 200 Runway Sealant, Elasto-Thane 5639 Runway Sealant, and Elasto-Thane 920 Runway Sealant;

Pecora Corporation products such as 860 Silicone Sealant, 863 Silicone Sealant, 864 Silicone Sealant, 890 Silicone Sealant, 895 Silicone Sealant, 896 High Performance Silicone Sealant, 985 Silicone Sealant, AC-20+ Silicone Sealant, AC-20 FTR Acrylic Latex Sealant, BC-158 Butyl Rubber Sealant, Dynaflex Polyurethane Sealant, Dynapoxy EP-1200 Epoxy Resin Sealant, Dynatred Polyurethane Sealant, Dynatrol I Polyurethane Rubber Sealant, Dynatrol II Polyurethane Rubber Sealant, EP-800 Epoxy Resin Sealant, GC-2 Synthacalk Polysulfide Rubber Sealant, GC-5 Synthacalk Polysulfide, GC-9 Synthacalk Polysulfide Rubber Sealant, M242 Glazing Compound, Urexpan NR-200 Polyurethane Sealant, Urexpan NR-201 Polyurethane Sealant, and Urexpan NR-300 Polyurethane Sealant;

#10 Epoxy Nosing Caulk sold by the R. C. A. Rubber Company;

ROP EEC Epoxy Caulking Compound (Stair Tread Nose Filler) sold by the Roppe Corporation;

Sonneborn Building Products products such as Epolith-G Epoxy Joint Filler, Epolith-P Epoxy Joint Filler, Omniplus Silicone Sealant, Omniseal Silicone Sealant, SBR Acrylic Sealant, Sonolac General Purpose Sealant, Sonolastic NP 1 Polyurethane Sealant, Sonolastic NP 2 Polyurethane Sealant, Sonolastic SL 1 Polyurethane Sealant, Sonolastic SL 2 Polyurethane Sealant, Sonolastic Two-Part Polysulfide Sealant, Sonolastic Ultra Polyurethane Sealant, Sonomeric 1 Polyurethane Sealant, and Sonomeric 2 Polyurethane Sealant;

S-48 Expansion Joint Sealant sold by Summitville Tiles, Inc.;

Tremco, Inc, products such as Dymeric 511 Polyurethane Sealant, Dymeric Epoxidized Polyurethane Sealant, Dymonic Polyurethane Sealant, HPL Polyurethane Sealant, Mono 555 Acrylic Sealant, Spectrem 2 Silicone Sealant, Spectrem 1 Silicone Sealant, THC-900/901 Polyurethane Sealant, Tremco Acrylic Latex Sealant, Tremco Butyl Sealant, Tremflex SL Sealant, Tremstop Acrylic Sealant, and Proglaze II Silicone Sealan; and products of Williams Products, Inc. such as Dyna Seal W-517, Dyna Seal W-814, Dyna Seal W-907, and Dyna Seal W-908.

What is claimed is:

1. A phosphate-free, neutral pH lubricant composition for facilitating the tooling of a newly applied caulking bead, which does not interact with the caulking compound sealant or prevent it from curing, and which further minimizes accumulation of caulking compound sealant on the implement used for tooling and is easily removed from the caulking compound sealant after curing, said composition comprising:

(a) at least one surfactant;

(b) at least one stabilizing compound;

(c) a biocide; and water.

2. The composition of claim 1 wherein said biocide comprises approximately 0.2% by weight of said composition.

3. The composition of claim 1 wherein each said surfactant is selected from a group consisting of ethoxylated alkyl sulfate anionic surfactants, amine oxide surfactants, non-ionic fatty acid amide surfactants, and sulfonate surfactants.

4. The composition of claim 3 wherein said ethoxylated alkyl sulfate anionic surfactants are present in the form of sodium salts, and further wherein said sodium salts of ethoxylated alkyl sulfate anionic surfactants comprise a minimum of approximately 4% by weight of said composition and a maximum of approximately 40% by weight of said composition.

5. The composition of claim 3 wherein said amine oxide surfactants comprise a maximum of approximately 10% by weight of said composition.

6. The composition of claim 3 wherein each said sulfonate surfactant is present in the form of a sodium or calcium salt, and wherein said sodium and calcium salts of said sulfonate surfactants comprise a maximum of approximately 10% by weight of said composition.

7. The composition of claim 3 wherein said non-ionic fatty acid amide surfactant comprises lauryl methyl glucamide.

8. The composition of claim 3 wherein said non-ionic fatty acid amide surfactants comprise a maximum of approximately 20% by weight of said composition.

9. The composition of claim 1 wherein said stabilizing compounds are selected from a group consisting of magnesium chloride and ethanol.

10. The composition of claim 9 wherein said magnesium chloride comprises a maximum of approximately 10% by weight of said composition and said ethanol comprises a maximum of approximately 5% by weight of said composition.

11. The composition of claim 1 further comprising ingredients selected from a group consisting of poloxamine, pentasodium penetrate, fragrance, hydrotropes, and thickening agents.

12. A pH neutral, phosphate-free lubricant composition for facilitating the tooling of a newly applied caulking bead, which does not interact with the caulking compound sealant or prevent it from curing, minimizes accumulation of caulking compound sealant on the implement used for tooling, and is easily removed from the caulking compound sealant after curing, said composition comprising approximately by weight:

(a) at least one ethoxylated alkyl sulfate anionic surfactant;

(b) at least one amine oxide surfactant;

(c) at least one non-ionic fatty acid amide surfactant;

(d) at least one sulfonate surfactant selected from a group consisting of sodium salts and calcium salts thereof;

(e) magnesium chloride;

(f) ethanol; and (g) water.

13. The composition of claim 12 further comprising a biocide, and wherein said biocide comprises approximately 0.2% by weight of said composition.

14. The composition of claim 12 wherein each said ethoxylated alkyl sulfate anionic surfactants is in the form of a sodium salt, and wherein said sodium salts of said ethoxylated alkyl sulfate anionic surfactants comprise a minimum of approximately 4% and a maximum of approximately 40% by weight of said composition; wherein said amine oxide surfactants, said magnesium chloride, and said sodium and calcium salts of said sulfonate surfactants each comprise a maximum of approximately 10% by weight of said composition; wherein said non-ionic fatty acid amide surfactants comprise lauryl methyl glucamide and a maximum of approximately 20% by weight of said composition; and wherein said ethanol comprises a maximum of approximately 5% by weight of said composition.

15. The composition of claim 12 further comprising ingredients selected from a group consisting of poloxamine, pentasodium penetrate, fragrance, hydrotropes, and thickening agents.

16. A method for tooling a bead of newly applied caulking compound sealant, wherein accumulation of sealant on the tooling implement is minimized without contamination of, chemical interaction with, or preventing the curing of tooled sealant, said method comprising the steps of:

providing a water-based phosphate-free lubricant composition having a neutral pH and comprising at least one surfactant and at least one stabilizer;

also providing a caulking bead tooling implement and an excess caulking compound removal device;

applying an amount of said lubricant composition between said implement and a bead of newly dispensed caulking compound sealant sufficient to prevent the sealant from adhering to said implement during tooling of the bead;

drawing said implement with at least light pressure across the caulking bead;

using said excess caulking compound removal device to eliminate excess caulking compound sealant prior to curing of the sealant; and repeating said steps of applying said lubricant composition, drawing said implement across the bead of caulking compound sealant, and using said excess caulking compound removal device until the entire bead of caulking compound sealant is smoothed and shaped to a desired configuration.

17. The method of claim 16 wherein each said surfactant is selected from a group consisting of ethoxylated alkyl sulfate anionic surfactants, amine oxide surfactants, non-ionic fatty acid amide surfactants, and sulfonate surfactants.

18. The method of claim 17 wherein each said ethoxylated alkyl sulfate anionic surfactants is present in the form of a sodium salt and said sodium salts of ethoxylated alkyl sulfate anionic surfactants comprise approximately 4% to 40% by weight of said lubricant composition; wherein said amine oxide surfactants comprise a maximum of approximately 10% by weight of said lubricant composition; wherein each said sulfonate surfactant is present in the form of a sodium or calcium salt and wherein said sodium and calcium salts of said sulfonate surfactants comprise a maximum of approximately 10% by weight of said lubricant composition; and wherein said wherein said non-ionic fatty acid amide surfactant comprises lauryl methyl glucamide and a maximum of approximately 20% by weight of said lubricant composition.

19. The method of claim 16 wherein each said stabilizer is selected from a group consisting of magnesium chloride and ethanol, and further wherein said magnesium chloride comprises a maximum of approximately 10% by weight of said lubricant composition and said ethanol comprises a maximum of approximately 5% by weight of said lubricant composition.

20. The method of claim 16 further comprising ingredients selected from a group consisting of biocides, poloxamine, pentasodium penetrate, fragrance, hydrotropes, and thickening agents.

* * * * *